US011787618B2

(12) United States Patent
Justus et al.

(10) Patent No.: US 11,787,618 B2
(45) Date of Patent: Oct. 17, 2023

(54) DISPENSING DEVICE FOR PRESSURIZED FLUIDS WITH AN ANTI-ACTUATION SYSTEM

(71) Applicant: APTAR DO BRASIL EMBALAGENS LTDA., Jundiaí (BR)

(72) Inventors: Rafael Justus, Maringá (BR); David Gerardo Baissero, Querétaro (MX); Ronnie Clayton Pereira, Maringá (BR); Marcelo Santarelli, Buenos Aires (AR)

(73) Assignee: APTAR DO BRASIL EMBALAGENS LTDA., Jundiaí (BR)

( * ) Notice: Subject to any disclaimer, the term of this patent is extended or adjusted under 35 U.S.C. 154(b) by 10 days.

(21) Appl. No.: 17/595,663

(22) PCT Filed: May 18, 2020

(86) PCT No.: PCT/BR2020/050170
§ 371 (c)(1),
(2) Date: Nov. 22, 2021

(87) PCT Pub. No.: WO2020/232520
PCT Pub. Date: Nov. 26, 2020

(65) Prior Publication Data

US 2022/0219883 A1 Jul. 14, 2022

(30) Foreign Application Priority Data

May 21, 2019 (BR) ..... 102019010372-8

(51) Int. Cl.
*B65D 83/22* (2006.01)
*B65D 83/40* (2006.01)
*B65D 83/20* (2006.01)
*B67D 1/04* (2006.01)

(52) U.S. Cl.
CPC ..... *B65D 83/40* (2013.01); *B65D 83/206* (2013.01); *B65D 83/22* (2013.01); *B65D 83/205* (2013.01); *B67D 1/04* (2013.01)

(58) Field of Classification Search
CPC ..... B65D 83/40; B65D 83/22; B65D 83/205; B65D 83/206; B67D 1/04
See application file for complete search history.

(56) References Cited

U.S. PATENT DOCUMENTS 3,169,673 A * 2/1965 Focht ..... B65D 83/345 222/533
3,373,908 A * 3/1968 Crowell ..... B65D 83/205 222/402.13

(Continued)

OTHER PUBLICATIONS

International Search Report and Written Opinon of the International Searching Authority issued in PCT/BR2020/050170 dated Nov. 26, 2020.

*Primary Examiner* — Frederick C Nicolas
(74) *Attorney, Agent, or Firm* — Amster, Rothstein & Ebenstein LLP

(57) ABSTRACT

Dispensing device for pressurized fluids with an anti-actuation system including a body and an actuation button, having an anti-actuation system for the actuation button, the anti-actuation system composed of a locking element connected to the body of an articulation that imparts a pivoting movement to the locking element.

11 Claims, 4 Drawing Sheets

(56) References Cited

U.S. PATENT DOCUMENTS 3,510,029 A * 5/1970 Doyle ..... B65D 83/206 222/402.12
3,744,682 A * 7/1973 Blank ..... B65D 83/206 222/402.11
3,904,088 A 9/1975 Milbourne, Sr.
4,067,482 A * 1/1978 Vogel ..... B65D 83/228 222/402.11
4,381,065 A * 4/1983 Hayes ..... B65D 83/206 222/153.02
4,442,955 A * 4/1984 Bush ..... B65D 83/206 222/153.07
4,482,082 A * 11/1984 Goncalves ..... B65D 83/205 222/182
5,722,568 A * 3/1998 Smith ..... B65D 83/40 220/281
6,085,945 A * 7/2000 Fransen ..... B65D 83/62 222/402.18
6,113,008 A * 9/2000 Arsenault ..... B65D 83/30 222/402.13
6,247,613 B1 6/2001 Meshberg
6,382,463 B2 * 5/2002 Meshberg ..... B05B 11/0038 222/321.9
6,382,469 B1 * 5/2002 Carter ..... B65D 83/228 222/402.13
6,739,481 B2 5/2004 Meshberg
6,817,488 B2 * 11/2004 Meshberg ..... B05B 11/0013 222/402.11
6,908,017 B2 * 6/2005 Mineau ..... B65D 83/205 222/402.1
6,971,552 B2 * 12/2005 Meshberg ..... B65D 83/40 222/402.11
7,527,173 B2 * 5/2009 Lasserre ..... B65D 83/206 222/402.11
7,731,062 B2 * 6/2010 Groys ..... B65D 83/20 222/402.1
8,403,184 B2 * 3/2013 Eberhardt ..... B65D 83/205 222/402.1
8,622,256 B2 * 1/2014 Campbell ..... B65D 83/22 222/402.11
8,752,735 B2 * 6/2014 Cohen ..... B05B 11/0064 222/321.9
8,881,944 B2 * 11/2014 Paas ..... B65D 83/201 222/402.15
2001/0020627 A1 9/2001 Meshberg
2006/0151547 A1 * 7/2006 Kolanus ..... B65D 83/205 222/402.13
2006/0219808 A1 * 10/2006 Woods ..... B05B 15/5223 239/117
2011/0017781 A1 * 1/2011 Nelson ..... B05B 1/1645 222/402.13

* cited by examiner

DISPENSING DEVICE FOR PRESSURIZED FLUIDS WITH AN ANTI-ACTUATION SYSTEM

CROSS-REFERENCE TO RELATED APPLICATIONS

This application is a U.S. national stage entry under 35 U.S.C. § 371 of PCT International Patent Application No. PCT/BR2020/050170, filed May 18, 2020, which claims priority to Brazilian Patent Application No. 102019010372-8, filed May 21, 2019, the contents of which are incorporated herein by reference in their entirety.

FIELD OF THE INVENTION

The present invention relates to a dispensing device for pressurized fluids, more specifically fluids contained in pressurized vessels, such as aerosols, having an anti-actuation system for the actuation button.

BACKGROUND OF THE INVENTION

A pressurized aerosol vessel has a release valve, usually activated when pressing its stem in the coaxial direction, in the direction of said vessel.

Dispensing devices for this type of pressurized vessel have different building aspects and functionalities. A widely used dispensing device is a small actuation button fixed to the stem of the release valve. This type of device needs a cover for its closure and, moreover, said device imparts fragility to the stem of the release valve, since any effort transverse to the valve stem can cause its breakage and consequently render the pressurized vessel unusable. In this case, the cover becomes indispensable to prevent the actuation button from being activated unintentionally during handling by a child or during transport.

There are other types of dispensing devices that have a more robust structure and protect the release valve stem. A fairly common shape is a device that fits into the upper edge of the pressurized vessel, usually a can, with an actuation button in the center. The involuntary actuation button activation problem still occurs in this type of device.

A recurring concern of the manufacturers of these products is how to prevent or hinder involuntary activation of the valve in various contexts, particularly in the distribution chain, whether in the transport between manufacturers and wholesalers/retailers, in the e-commerce chain, or on the sales shelf during the storage or replacement process, as well as, immediately after sale, how to prevent involuntary activation by the consumer when he/she makes the transport and storage in his/her residence. Due to the toxicity of the products, another concern of some manufacturers is how to make activation difficult for a child handling the valve.

Some documents in the state of the art address ways of locking or blocking the actuation button of this type of device, as one can see from documents U.S. Pat. Nos. 7,527,173, 6,908,017, 6,247,613, and 3,904,088.

Document U.S. Pat. No. 6,908,017 presents a spray device that has a spray channel locking system that prevents the fluid from being sprayed or makes it difficult to be sprayed. The problem of this system is that it closes the outlet hole of the spray channel, but does not prevent the actuation button from being activated, which may cause the channel to clog, in addition to an occasional leakage through the locking system.

Documents U.S. Pat. Nos. 7,527,173, 6,247,613, and 3,904,088 present spray devices with a system that prevents the actuation button activation, but in all cases there is a cover in the spray channel. Additionally, documents U.S. Pat. Nos. 6,247,613 and 3,904,088 present spray devices built in more than one piece, which implies loss of practicality and higher cost of both production of the cover and assembly of said cover in the pressurized vessel.

A solution widely applied in the state of the art to prevent the actuation button from being activated is the use of two rotating pieces, as presented in documents U.S. Pat. Nos. 6,758,373 and 7,611,032, where it is necessary for the user to perform a rotating movement between the two pieces to lock or unlock the actuation button. Also, this solution does not allow for the device to be built as a single piece, enforcing users to lock and unlock it using both hands.

Therefore, the solutions presented in the state of the art do not fully solve the problem of offering a spray device built as a single piece and with a system that prevents the actuation button from being activated.

BRIEF DESCRIPTION OF THE INVENTION

The present invention features a dispensing device for pressurized fluids, such as aerosols, wherein said device comprises a cover, which is made as a single piece and has a body that secures the lid on the pressurized vessel, and an actuation button connected to the body so that said actuation button can move towards the actuation valve (VA). Additionally, the present invention provides an anti-actuation system for the actuation button.

An object of the present invention is to offer a one-piece cover.

Another object of the present invention is to offer an anti-actuation system that prevents the actuation button from being activated accidentally or involuntarily.

Still another object of the present invention is to offer a locking system capable of remaining in the open or closed position without moving until the user deliberately manipulates it.

Finally, it is also an object of the present invention to offer a seal that breaks in the first use of the actuation button.

BRIEF DESCRIPTION OF THE DRAWINGS

The subject matter of this description will be fully clear in its technical aspects from the detailed description to be made based on the figures listed below, namely.

DETAILED DESCRIPTION OF THE INVENTION

Figure 1:
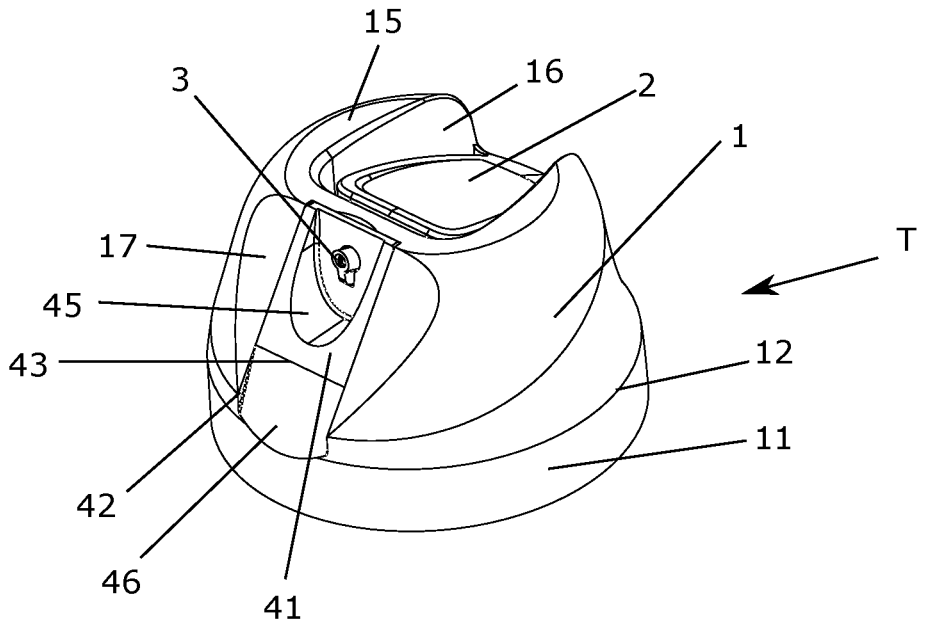
FIG. 1 shows a perspective view of an embodiment of the device with the anti-actuation system closed, wherein said anti-actuation system has an articulation below the spray channel and the lock has a hollow region.

According to the aforementioned figures, the present invention, i.e., "DISPENSING DEVICE FOR PRESSURIZED FLUIDS WITH AN ANTI-ACTUATION SYSTEM", comprises a cover (T) that has a body (1) connected to an actuation button (2), wherein said actuation button (2) has a spray channel (3) and an anti-actuation system (4) that prevents the actuation button (2) from moving coaxially to an actuation valve (VA) stem.

The body (1) is the outer part of the lid (T), which has a thin wall and a base (11) essentially cylindrical with an open bottom and which tapers toward the top that is closed.

In an embodiment of the present invention, the base (11) connects to a concave radius (13), forming an edge (12) at the junction of the two parts. The curvature of the concave radius (13) decreases until it reaches the inflection point where the convex radius (14) starts. Said convex radius (14) increases the curvature to the flat top (15), where said flat top (15) forms the body (1) cover.

The base (11) has fixation means on its inner side, where said fixation means hold the body (1) in a pressurized vessel (VP), such as an aerosol or congener spray, either directly in the vessel or in the actuation valve (VA). In an embodiment of the present invention, the fixation means is made up of a rib (5) of semicircular profile that runs through the circumference of the inner wall and a limiter ring (6), that limits the portion of the pressurized vessel (VP) that enters the body (1) of said cover (T).

The top of the body (1) has a gap where the actuation button (2) is housed, in the inner part of the gap there is a guide wall (16) that prevents any lateral displacements of the actuation button (2) and protects the inside of the body (1).

Said actuation button (2) is located below the top of the body (1), so that it is protected from accidental shocks or activation. Said actuation button (2) is connected to the body (1) by a flexible region (7) that imparts to the actuation button (2) a pivoting movement and allows coaxial movement to the stem of the actuation valve (VA), so that pressing the actuation button (2) causes the release of fluid from inside the pressurized vessel (VP).

In an embodiment of the present invention, the actuation button (2) forms a flat, essentially rectangular and of inclined surface, forming a ramp that converges towards the top of the body (1). Alternatively in this embodiment, a rib (21) can be used at the lower edge of the actuation button (2) in order to give greater structural rigidity to said actuation button (2).

In a possible embodiment of the present invention, the body (1) has in its front portion a chamfer (17), which is an angled cutout, essentially flat, where the gap (9) through which the spray channel passes is located.

At the bottom of the actuation button (2) is the valve stem fitting (8), which is where the actuation valve stem (VA) engages, and said valve stem fitting (8) is connected to the spray channel (3).

In an embodiment of the present invention, the valve stem fitting (8) and the spray channel (3) are arranged at an angle between 90° and 180°, with the spray channel (3) facing the front of the cover (T), and there may be a gap (9) in the front portion of the body (1), where the end of said spray channel (3) is located.

In an embodiment of the present invention, the end of the spray channel (3) can receive another element in its outlet, in a fixed or removable way, such as a duct, flexible or rigid, to assist in the deposition of material in places of difficult access, for example.

Additionally, the spray channel (3) may be able to receive a rupture insert, mechanical or non-mechanical.

The spray channel (3) can have more than one outlet, allowing a dispersion in different directions or with a larger dispersion area.

The anti-actuation system (4) prevents the actuation button (2) from moving, thereby preventing the actuation valve stem (VA) from being pressed, consequently preventing the release of fluid from the pressurized vessel (VP).

Figure 2:
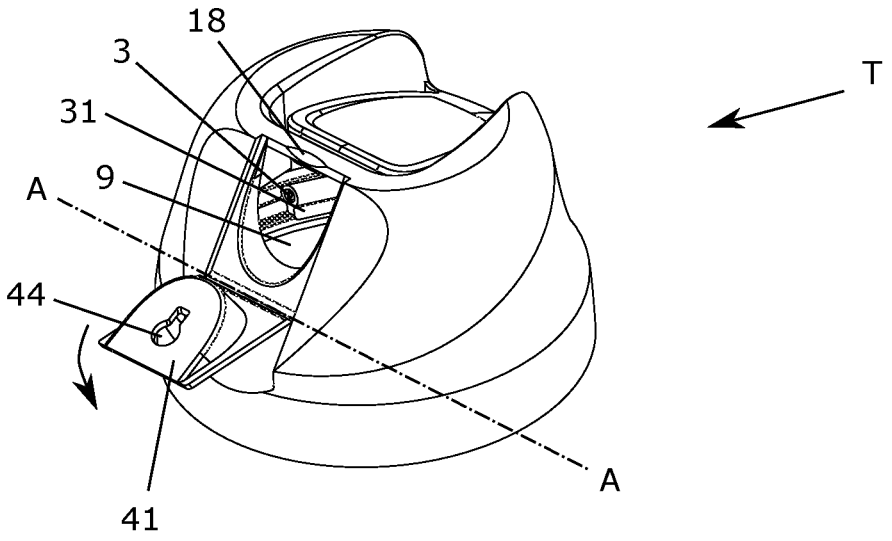
FIG. 2 shows a perspective view of an embodiment of the device with the anti-actuation system being opened, wherein said anti-actuation system has an articulation below the spray channel and the lock has a hollow region.
Figure 3:
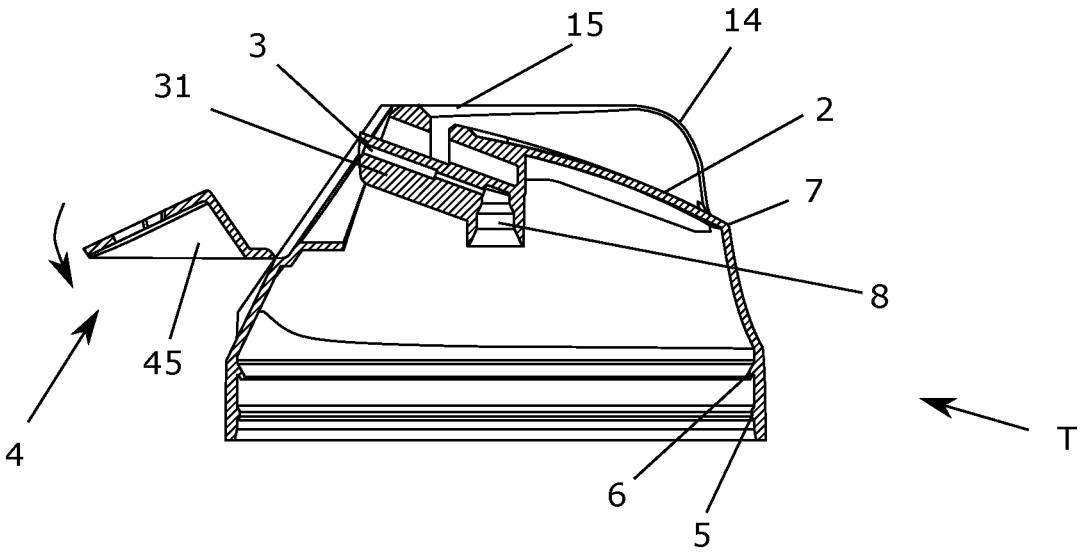
FIG. 3 shows a left side sectional view of an embodiment of the device with the anti-actuation system being opened, wherein said anti-actuation system has an articulation below the spray channel and the valve stem fitting and spray channel form an angle of 110°.
Figure 4:
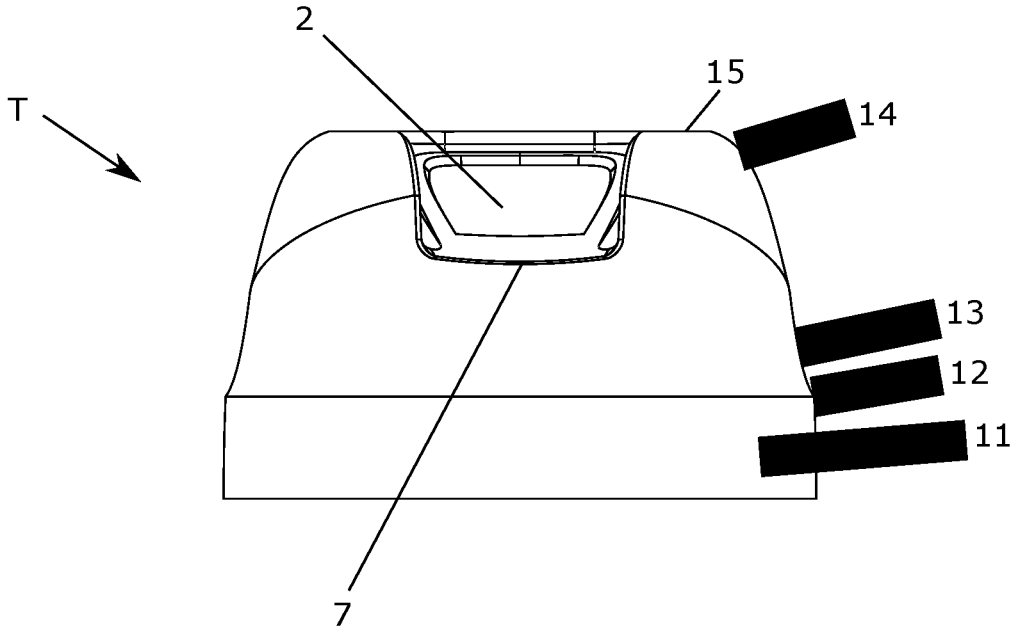
FIG. 4 shows a rear view of an embodiment of the device.
Figure 5:
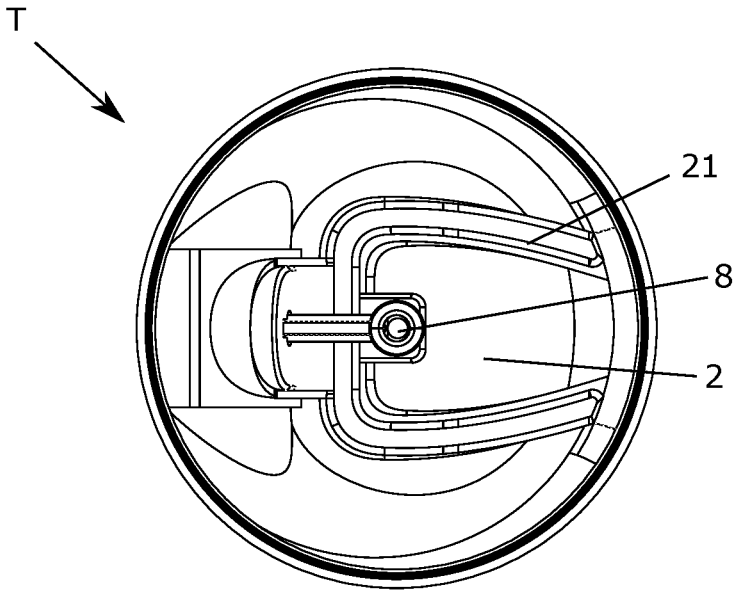
FIG. 5 shows a bottom view of an embodiment of the device.
Figure 6:
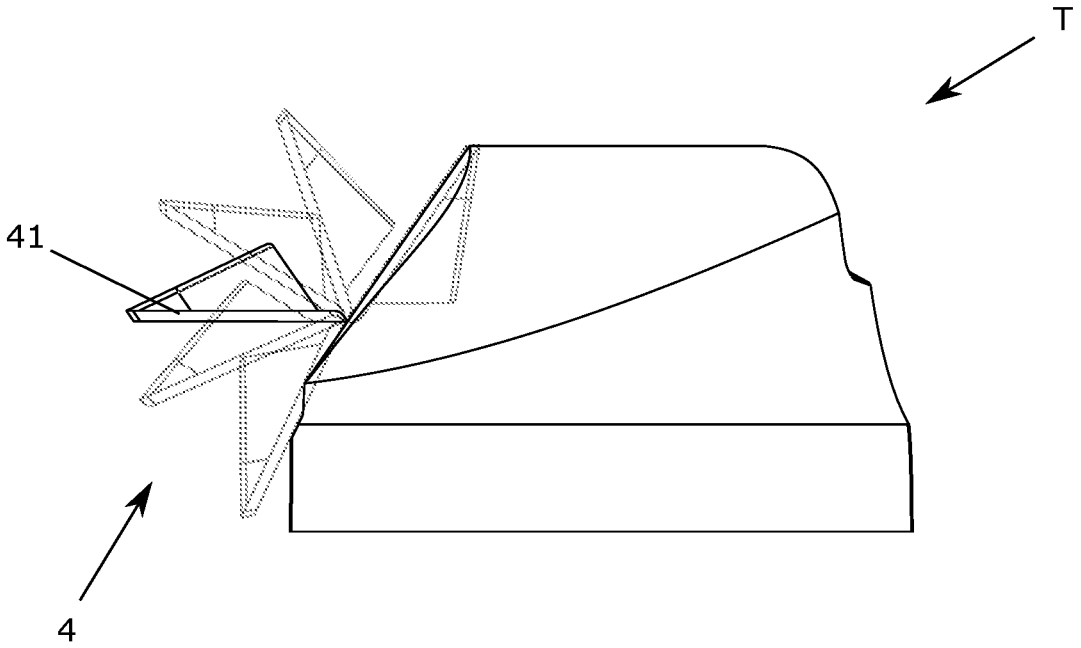
FIG. 6 shows a left side view of an embodiment of the device illustrating the movement of the lock, wherein the anti-actuation system has an articulation below the spray channel.
Figure 7:
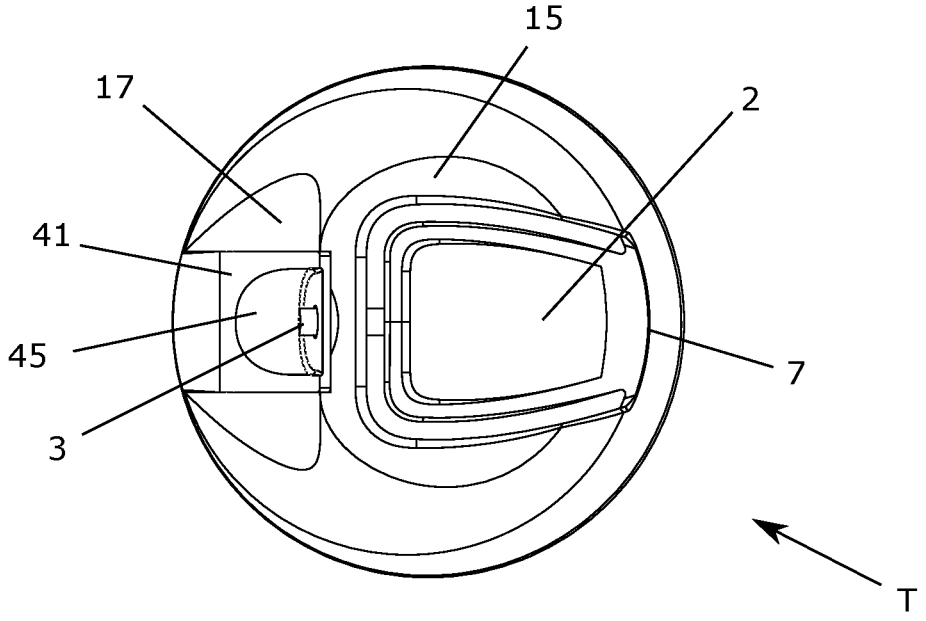
FIG. 7 shows an upper view of an embodiment of the device.

In an embodiment of the present invention, the anti-actuation system (4) is composed of a locking element (41) that has an articulation (43), which allows said locking element (41) to perform a pivot movement toward the spray channel (3). In the closed position, the locking element (41) prevents the movement of the spray channel (3), thus preventing the movement of the actuation button (2), as shown in FIG. 1. In this embodiment, it is preferable that there is a reinforcement (31) next to the spray channel (3) for improved rigidity, as a way to prevent said spray channel (3) from being flexed. When rotating the locking element (41) to the open position, the spray channel (3) is released, previously anchored/supported, thus allowing the activation of the actuation button (2). In FIG. 2, one can see the locking element (41) moving to the open position, rotating on the "AA" axis. FIG. 6 shows a complete illustration of the movement of the locking element (41).

The articulation (43) can be positioned above or below the spray channel (3). Alternatively, the articulation (43) can have a spring effect, which maintains the locking element (41) in the open or closed position. Additionally, means to secure and hold the locking element (41) can be used in the open or closed position. In an embodiment of the present invention, there is a fixing recess (46) that accommodates the locking element (41) when in the open position and maintains said locking element (41) in position through protrusions (42) in the form of ribs or embossed dots on the body (1).

The anti-actuation system (4) may contain a locking element (41) with a hollow region (44) for accommodation of the spray channel (3), so when the locking element (41) is in the closed position, said hollow region (44) accommodates the spray channel (3), preventing the spray channel from moving. Said hollow region (44) can have the geometry of the spray channel (3). Additionally, in this embodiment, the locking element can contain a recess (45), which forms a wall, in the same direction as the movement of the actuation valve stem (VA), for better accommodation of the spray channel (3), in the hollow region (44).

In another embodiment of the present invention, said locking element (41) may be a non-hollow housing where the spray channel (3) accommodates when the locking element (41) is in the closed position. Said housing can have the shape of the spray channel (3), of a circle, of a square, or another shape that allows said spray channel (3) to be accommodated inside when the locking element (41) is in the closed position, preventing the actuation button (2) from moving.

In still another embodiment of the present invention, there is anti-actuation system (4) where the locking element (41) has in its inner part ribs that, when said locking element (41) is in the closed position, prevent the actuation button (2) from moving.

To facilitate the opening of the locking element (41), an opening recess (18), located on the body (1), can be used so as to make the start of the locking element (41) movement to the open position easier. Another way to facilitate the opening is to use a tab in the locking element (41), so that it is possible for the user to position his/her finger on said tab to move the locking element.

Additionally, the locking element (41) can be built in the closed position, with breaking points in the form of a seal that breaks at the first opening of the locking element (41). In this embodiment, the breaking points can be around the locking element (41) or in the housing of the spray channel (3).

One can also have as a sealing element breaking points between the body (1) and the actuation button (2), which break with the first activation of said actuation button (2).

The main advantage of this invention is that it offers a spraying device for pressurized vessels (VP), such as aerosols, which is functional and manufactured as a single piece, thus facilitating the production and assembly process in the pressurized vessel (VP), in addition to presenting an effective, simple, and easy-to-handle anti-actuation system, which prevents or hinders accidental or improper activation in the open or closed position and can also perform the sealing function.

It should be understood that this description does not limit the application to the details described herein and that the invention is capable of other modalities, as well as to be practiced or executed in a variety of ways within the scope of the claims. Although specific terms have been used, such terms should be interpreted in a generic and descriptive sense, and not for the purpose of limitation.

The invention claimed is:

1. A dispending device for pressurized fluids with an anti-actuation system comprising:

a cover with a body and an actuation button 2;

a spray channel that releases the pressurized fluids when the actuation button is activated; and a reinforcement member disposed below the spray channel to prevent flexing of the spray channel, wherein the cover has an anti-actuation system for the actuation button, said anti-actuation system is composed of a locking element connected to the body through an articulation that imparts pivoting movement to said locking element, the locking element comprising a hollow region that is in a shape of circle with an extending portion to accommodate the spray channel and the reinforcement member, the locking element having a locked configuration in which the locking element is pivoted so that the spray channel and the reinforcement member are held within the hollow region to prevent the actuation button from being activated and an unlocked configuration in which the locking element is pivoted so that the spray channel and the reinforcement member are disengaged from the hollow region.

2. The device, according to claim 1, wherein the articulation is below the spray channel.

3. The device, according to claim 1, wherein the cover has means for maintaining the locking element in the locked and/or unlocked configuration.

4. The device, according to claim 3, wherein the means to maintain the locking element in the locked and/or unlocked position are protrusions.

5. The device, according to claim 1, wherein the articulation has a spring effect maintaining the locking element in the unlocked or locked position.

6. The device, according to claim 1, wherein the cover has, at the bottom of the actuation button, a valve stem fitting connected to the spray channel.

7. The device, according to claim 6, wherein the spray channel and the valve stem fitting form an angle of 90°.

8. The device, according to claim 6, wherein the spray channel and the valve stem fitting form an angle greater than 90° and up to 180°.

9. The device, according to claim 1, wherein the locking element has breaking points configured to break upon a first unlocking of the locking device.

10. The device, according to claim 9, wherein the breaking points are between the locking element and the body.

11. The device, according to claim 1, wherein the cover has the actuation button connected to the body by a flexible region in the rear portion of the cover.

* * * * *